US011596221B2

(12) United States Patent
Lin

(10) Patent No.: US 11,596,221 B2
(45) Date of Patent: Mar. 7, 2023

(54) LIFTING TABLE STAND

(71) Applicant: TIMOTION TECHNOLOGY CO., LTD., New Taipei (TW)

(72) Inventor: Yu-Chang Lin, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/465,649

(22) Filed: Sep. 2, 2021

(65) Prior Publication Data

US 2023/0029425 A1 Jan. 26, 2023

(30) Foreign Application Priority Data

Jul. 21, 2021 (TW) ..... 110208578

(51) Int. Cl.
*A47B 9/20* (2006.01)

(52) U.S. Cl.
CPC ..... *A47B 9/20* (2013.01); *A47B 2200/0052* (2013.01); *A47B 2200/0057* (2013.01)

(58) Field of Classification Search
CPC ..... A47B 9/00; A47B 2009/043; A47B 2200/0052; A47B 2200/0057
USPC ..... 108/147
See application file for complete search history.

(56) References Cited

U.S. PATENT DOCUMENTS 6,148,741 A * 11/2000 Motta ..... A47B 9/04 108/147
8,104,410 B2 * 1/2012 Lanfear ..... A47B 9/20 108/157.1
8,661,989 B2 * 3/2014 Tsai ..... A47B 9/04 108/9
10,531,732 B1 * 1/2020 Huang ..... F16B 7/14
10,555,602 B1 * 2/2020 Lu ..... A47B 9/04
10,588,401 B1 * 3/2020 Lu ..... A47B 9/04
10,912,380 B1 * 2/2021 Lu ..... G01P 13/00
2008/0178779 A1 * 7/2008 Agee ..... A47B 9/04 108/147
2016/0088930 A1 * 3/2016 Hansen ..... A47B 9/10 248/188.5
2016/0106205 A1 * 4/2016 Hall ..... A47B 13/081 700/275

(Continued)

FOREIGN PATENT DOCUMENTS

EP 2823731 B1 * 1/2018 ..... A47B 13/02

*Primary Examiner* — Jose V Chen
(74) *Attorney, Agent, or Firm* — Chun-Ming Shih; HDLS IPR Services

(57) ABSTRACT

A lifting table stand includes a pair of telescopic columns, a carrier, an actuation module and a passive mechanism. Each telescopic column includes multiple tubes adapted to sheathe with each other and move telescopically relative to each other. The carrier includes a beam straddling the telescopic columns and a pair of support members perpendicularly connected to two ends of the beam. The actuation module includes a receiving member detachably installed to the beam and a driver connected to the receiving member. The passive mechanism includes a transmission shaft and a pair of gear sets installed in the tubes. The transmission shaft passes the driver and is connected to each gear set. Since the receiving member is detachably installed to beam, the actuation module may be changed to different types to control the elevation of the lifting table stand.

9 Claims, 8 Drawing Sheets

(56) References Cited

U.S. PATENT DOCUMENTS

| | | | | |
|---|---|---|---|---|
| 2016/0170402 | A1* | 6/2016 | Lindström | G05B 19/402 700/275 |
| 2016/0345722 | A1* | 12/2016 | Chen | A47B 9/04 |
| 2017/0135466 | A1* | 5/2017 | Randløv | A47B 9/04 |
| 2017/0303679 | A1* | 10/2017 | Tseng | A47B 9/04 |
| 2018/0368569 | A1* | 12/2018 | Laing | A47B 17/02 |
| 2019/0029413 | A1* | 1/2019 | Patton | A47B 3/06 |
| 2019/0069669 | A1* | 3/2019 | Hall | A47B 21/06 |
| 2019/0261778 | A1* | 8/2019 | Lukas | G01S 7/497 |
| 2020/0154876 | A1* | 5/2020 | Liu | A47B 9/00 |
| 2020/0196747 | A1* | 6/2020 | Lu | A47B 9/00 |
| 2020/0229588 | A1* | 7/2020 | Chen | A47B 9/04 |
| 2020/0329861 | A1* | 10/2020 | Zhang | A47C 7/72 |
| 2020/0359785 | A1* | 11/2020 | Lu | A47B 9/00 |
| 2021/0030146 | A1* | 2/2021 | Riebner | A47B 9/00 |
| 2021/0100355 | A1* | 4/2021 | Jørgensen | A47B 9/20 |
| 2021/0100356 | A1* | 4/2021 | Huang | A47B 17/03 |

* cited by examiner

LIFTING TABLE STAND

BACKGROUND OF THE DISCLOSURE

Technical Field

The technical field of this disclosure relates to a lifting table stand, and more particularly to a lifting table stand that may be installed with various types of actuation modules.

Description of Related Art

In order to fit different body types, heights, and using habits of users, many electric lifting tables with adjustable height and position are designed and sold on the market, so that users can adjust the table height as needed to achieve the purpose of comfortable usage of the table.

In a related-art lifting table stand, a small number of actuation modules are used to adjust the height and position manually, and most of the actuation modules are used to lift or lower the table stand through electric motors, or to directly control the height of the lifting through control box.

However, the actuation module of the related-art lifting table stand is usually set up and assembled at the factory, so that consumers do not have the choice to adjust the table stand according to their own needs, and the types of lifting table stands that can be selected at the time of purchase are limited. Therefore, it is a main subject for related manufacturers to overcome the aforementioned drawbacks of the related-art lifting table stand and make the lifting table stand applicable to different actuation modules at the same time to facilitate the replacement for users according to the needs.

In view of the aforementioned drawbacks of the related-art lifting table stand, the discloser of this disclosure based on years of experience in the related industry to conduct extensive research and experiment, and finally provided a feasible solution to overcome the drawbacks of the related art.

SUMMARY OF THE DISCLOSURE

Therefore, it is a primary objective of this disclosure to provide a lifting table stand that may be installed with an actuation module of different types to achieve the effect of using the lifting table stand universally.

To achieve the aforementioned and other objectives, this disclosure discloses a lifting table stand including a pair of telescopic columns, a carrier, an actuation module and a passive mechanism. The telescopic columns are arranged spacedly from each other and each telescopic column includes a plurality of tubes adapted to sheathe with each other and move telescopically relative to each other. The carrier includes a beam and a pair of support members, and the beam straddles the telescopic columns, and the support members are perpendicularly connected to two ends of the beam, and each support member and the beam are fixed to each tube. The actuation module includes a receiving member and a driver connected to the receiving member, and the receiving member is detachably installed to the beam. The passive mechanism includes a transmission shaft and a pair of gear sets, and the gear sets are arranged in the inner tubes respectively, and the transmission shaft passes the driver and is connected to each gear set.

This disclosure has the following effects. Through each connecting member fixed to each inner tube, the carrier may be installed directly on each connecting member for a quick and simple installation/removal. By the connecting member that is formed and bent into a U-shape, the weight of the connecting member may be reduced effectively. Through the passive mechanism, the rotation generated by the actuation module may drive the screw rod inside the inner tube to lift.

DETAILED DESCRIPTION OF THE EMBODIMENTS

Figure 1:
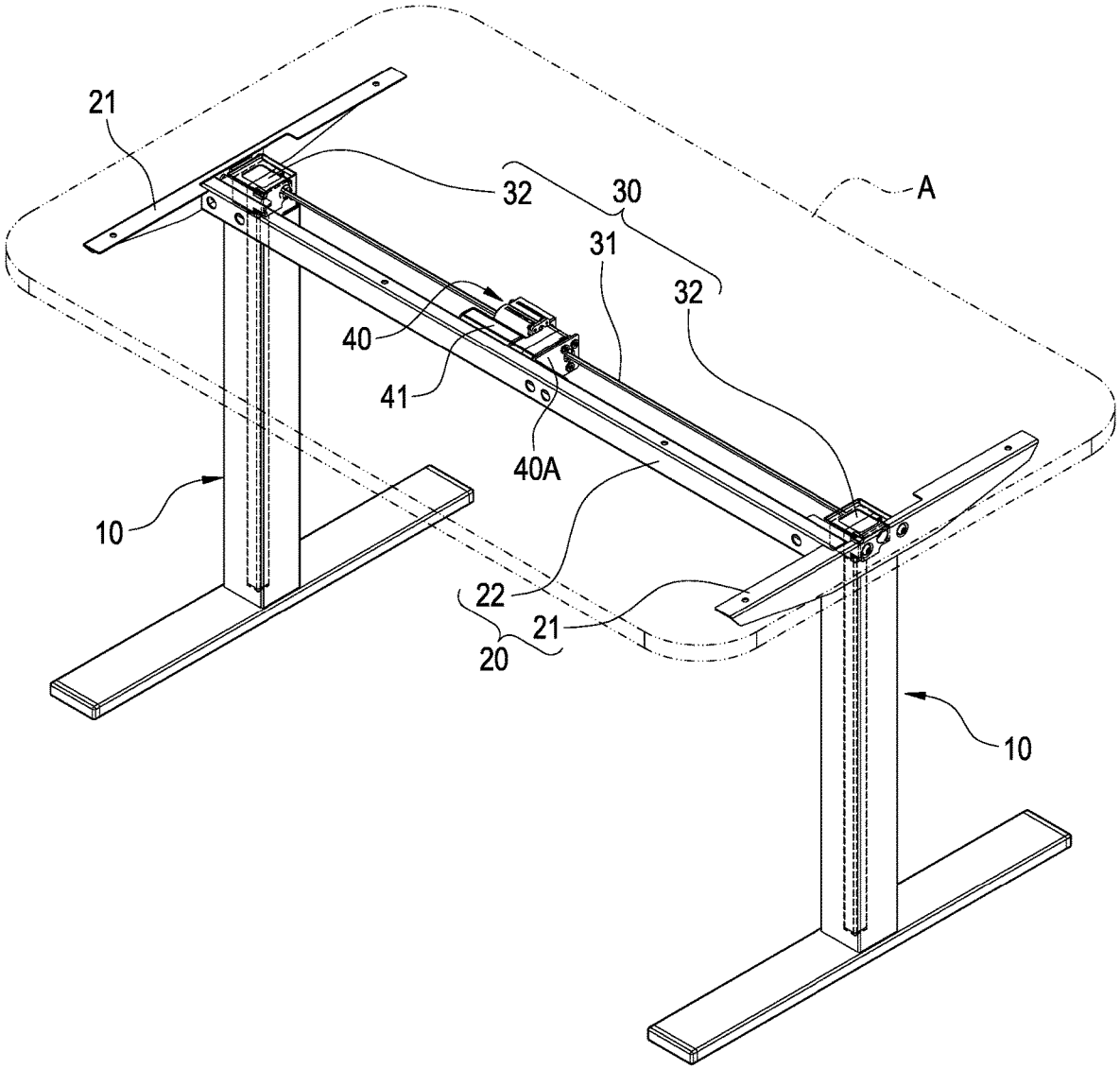
FIG. 1 is a perspective view of a first embodiment of this disclosure.
Figure 2:
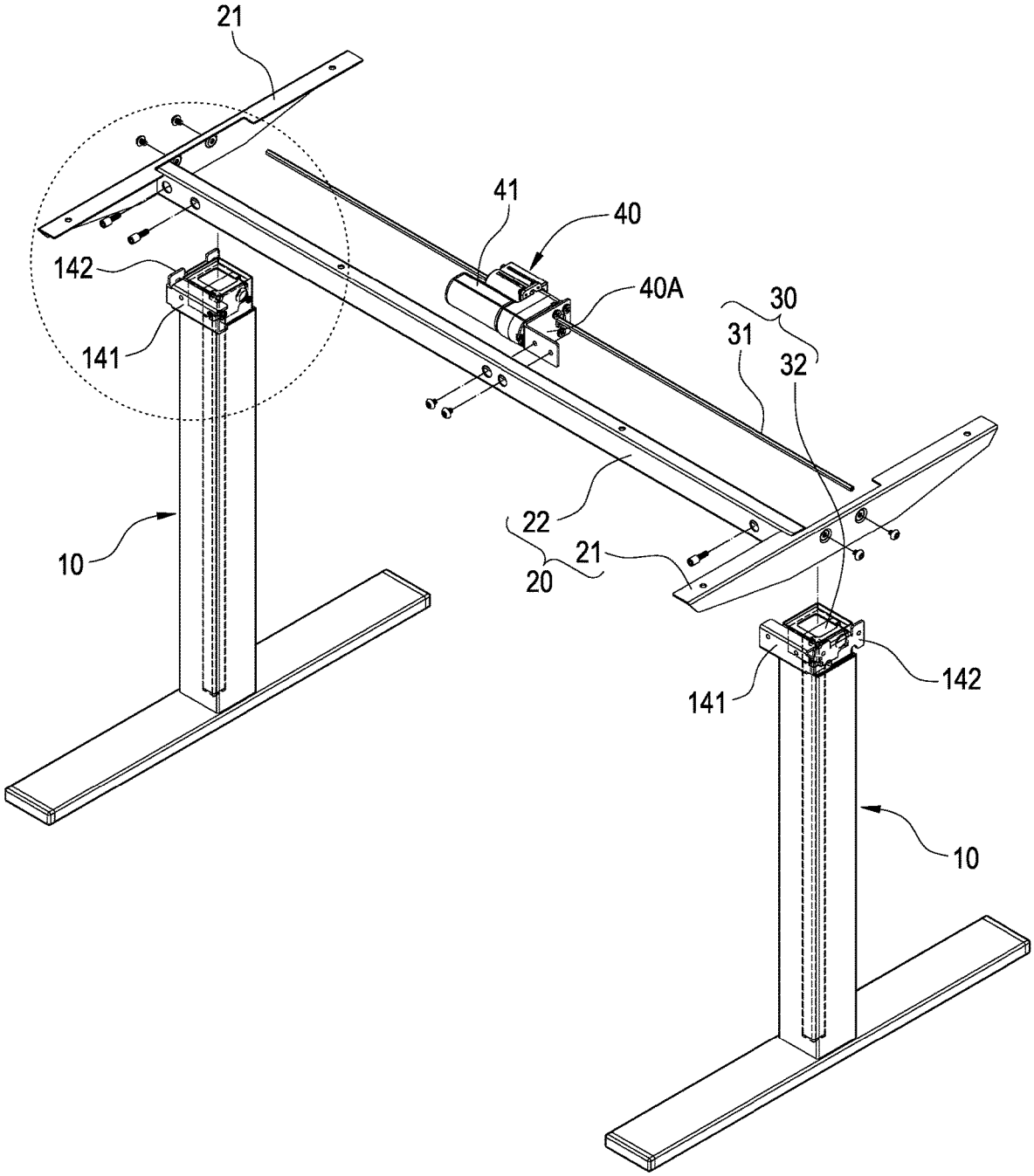
FIG. 2 is an exploded view of the first embodiment of this disclosure.
Figure 3:
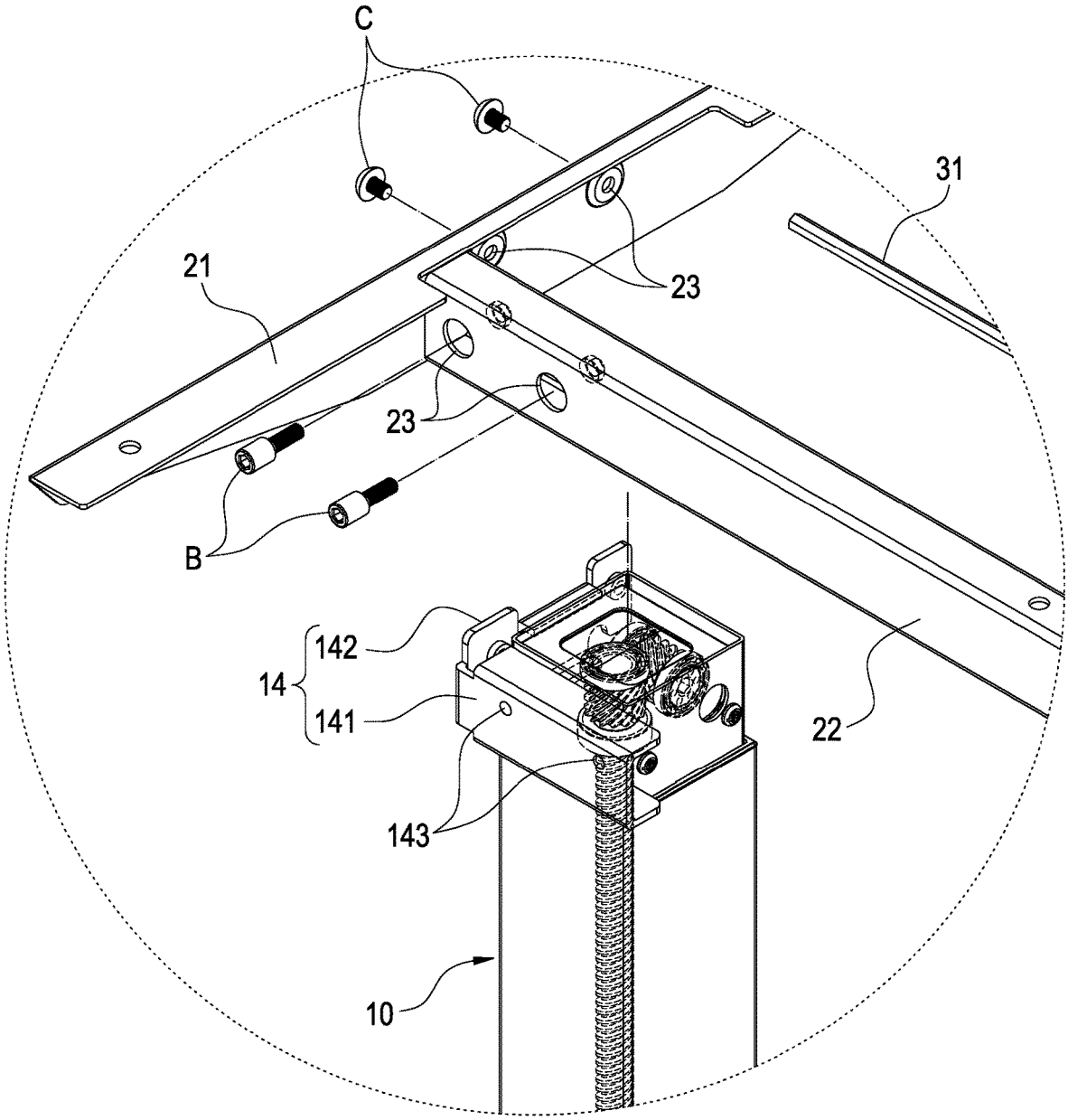
FIG. 3 is a partial enlarged view of FIG. 2.
Figure 4:
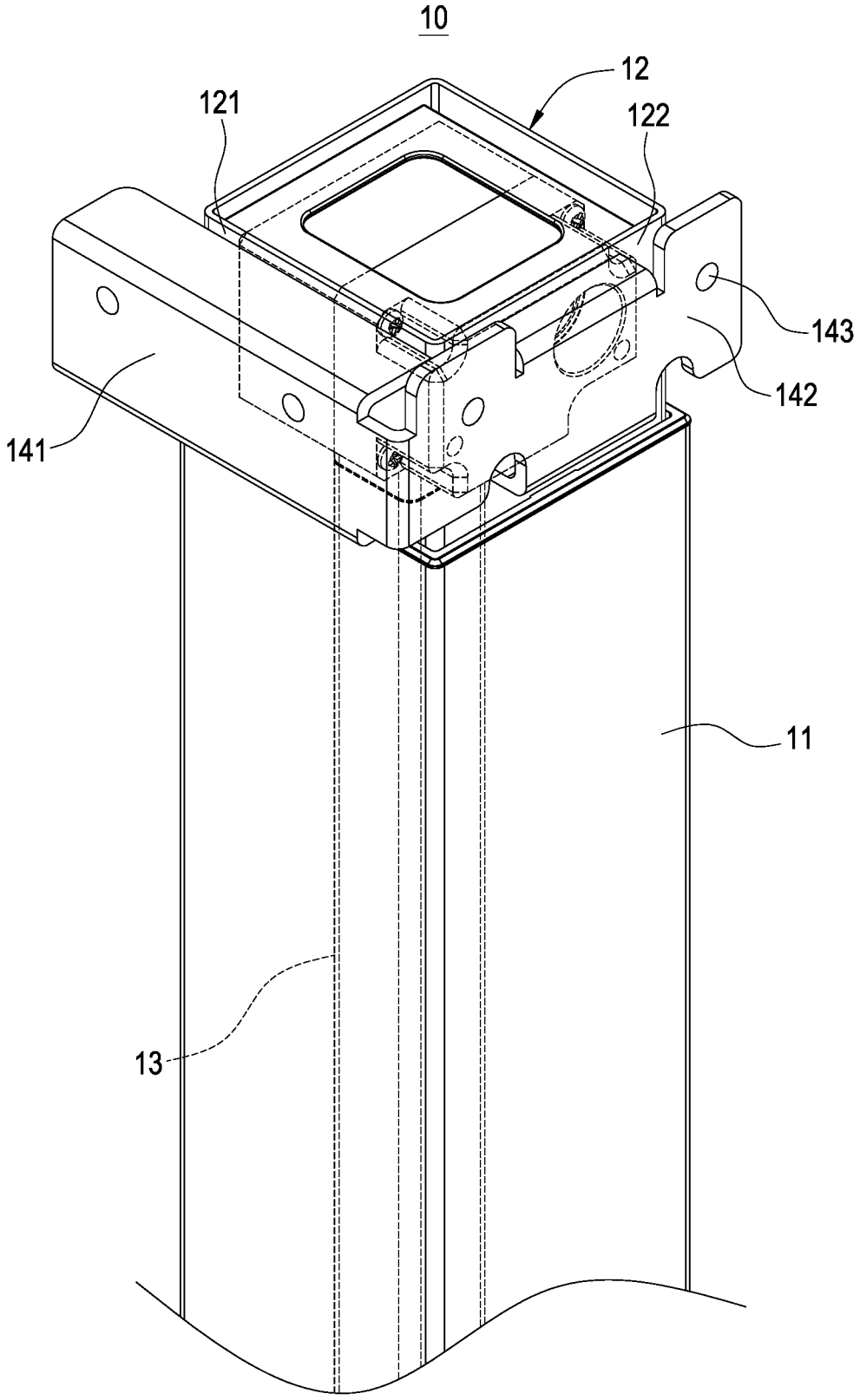
FIG. 4 is a perspective view showing a telescopic column and a connecting member of this disclosure.
Figure 5:
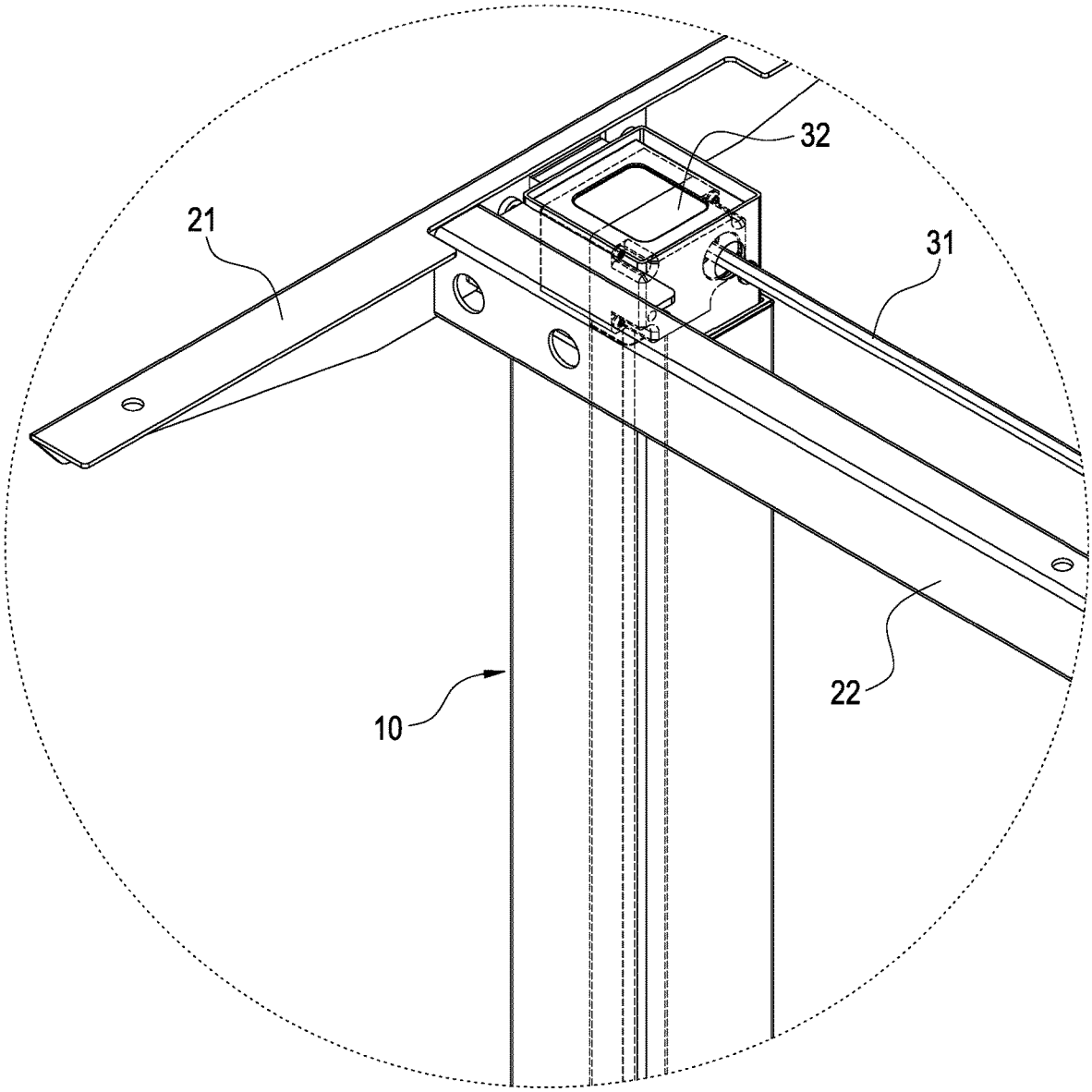
FIG. 5 is a perspective view of FIG. 3.

The technical contents of this disclosure will become apparent with the detailed description of embodiments accompanied with the illustration of related drawings as follows. It is intended that the embodiments and drawings disclosed herein are to be considered illustrative rather than restrictive.

With reference to FIGS. 1 to 5 for a lifting table stand for bearing and supporting a tabletop A in accordance with the first embodiment of this disclosure, the lifting table stand of this embodiment includes a pair of telescopic columns 10, a carrier 20, an actuation module 40 and a passive mechanism 30.

The telescopic columns 10 are arranged spacedly from each other and each telescopic column 10 includes a plurality of tubes adapted to sheathe with each other and move telescopically relative to each other. In this embodiment, the tube includes an outer tube 11, an inner tube 12 and a screw rod 13. The inner tube 12 is installed in the outer tube 11, and the inner tube 12 may move telescopically relative to the outer tube 11 through the screw rod 13. In this embodiment, the outer tube 11 and the inner tube 12 are hollow square tubes made of carbon steel or alloy steel. This disclosure is not just limited to such materials only, and the outer tube 11 and the inner tube 12 may also be hollow tubes made of other metals or alloys with a specific strength, and the hollow tube may be in an angular, circular or polygonal shape.

The carrier 20 is made of metal such as carbon steel or alloy steel. The carrier 20 includes a beam 22 and a pair of support members 21. The beam 22 straddles the telescopic columns 10, and the support members 21 are perpendicularly connected to two ends of the beam 22. In some embodiments, the beam 22 and each support member 21 are fixed by welding. This disclosure is not just limited to such arrangement only, and the beam 22 and each support member 21 may also be fixed by a screw. Each support member 21 and the beam 22 are fixed to the top end of each inner tube 12, and each support member 21 and beam 22 jointly support the tabletop A. When the inner tube 12 moves telescopically in the outer tube 11, the carrier 20 and the tabletop A are driven to lift together.

The actuation module 40 includes a receiving member 40A and a driver connected to the receiving member 40A. In this embodiment, the driver is a current cutoff motor (or direct cut type motor) 41 arranged corresponding to the position of two limit switches (not shown in the figures) to control the upper and lower height limits for the lifting. The receiving member 40A is an L-shaped sheet structure made of metal such as carbon steel or alloy steel, but this disclosure is not limited to such structure only. The receiving member 40A together with the driver are detachably installed on the beam 22 to achieve the effect of changing the actuation module 40 of different types.

The passive mechanism 30 includes a transmission shaft 31 and a pair of gear sets 32. Each gear set 32 is installed in each inner tube 12 and engaged with the corresponding screw rod 13, and the transmission shaft 31 passes the driver on the receiving member 40A and is connected to each gear set 32. The driver of the actuation module 40 drives the transmission shaft 31 to rotate, and each gear set 32 drives the corresponding screw rod 13 to lift each inner tube 12 in each outer tube 11. In some embodiments, the transmission shaft 31 has a cross-section in a hexagonal shape. This disclosure is not limited to such shape only, but it also can be in a quadrilateral or pentagonal shape. Therefore, the transmission shaft 31 may be well driven by the actuation module 40 to rotate.

Further, the telescopic column 10 further includes a pair of connecting members 14. The connecting member 14 is made of a carbon steel sheet or an alloy steel sheet and includes a first connecting plate 141 and a second connecting plate 142 perpendicularly connected to the first connecting plate 141. In some embodiments, the first connecting plate 141 and the second connecting plate 142 are manufactured in one piece form by bending. The upper and lower long sides of the first connecting plate 141 and the second connecting plate 142 are bent inwardly into a substantially U-shape, and the upper and lower long sides are connected and fixed to the inner tube 12. In some embodiments, the first connecting plate 141 and the second connecting plate 142 are fixed to the inner tube 12 by welding, so that the weight of the connecting member 14 may be reduced effectively. In this embodiment, each of the two inner tubes 12 has a joint surface 121 located on the same plane and an outer side 122 perpendicular to each joint surface 121. The first connecting plate 141 is fixed to the joint surface 121, and the second connecting plate 142 is fixed to the outer side 122, and each first connecting plate 141 is provided for connecting and fixing the beam 22, and each second connecting plate 142 is provided for connecting and fixing each support member 21.

In addition, the first connecting plate 141 and the second connecting plate 142 respectively have a plurality of screws holes 143, and the support member 21 and the beam 22 have a plurality of fixing holes 23 formed thereon respectively. The lifting table stand of this disclosure further includes a plurality of screws B, C, each of the screws B, C passes through each fixing hole 23 to be screwed with each screw hole 143, so that the carrier 20 may be fixed to each connecting member 14 on each inner tube 12.

Figure 6:
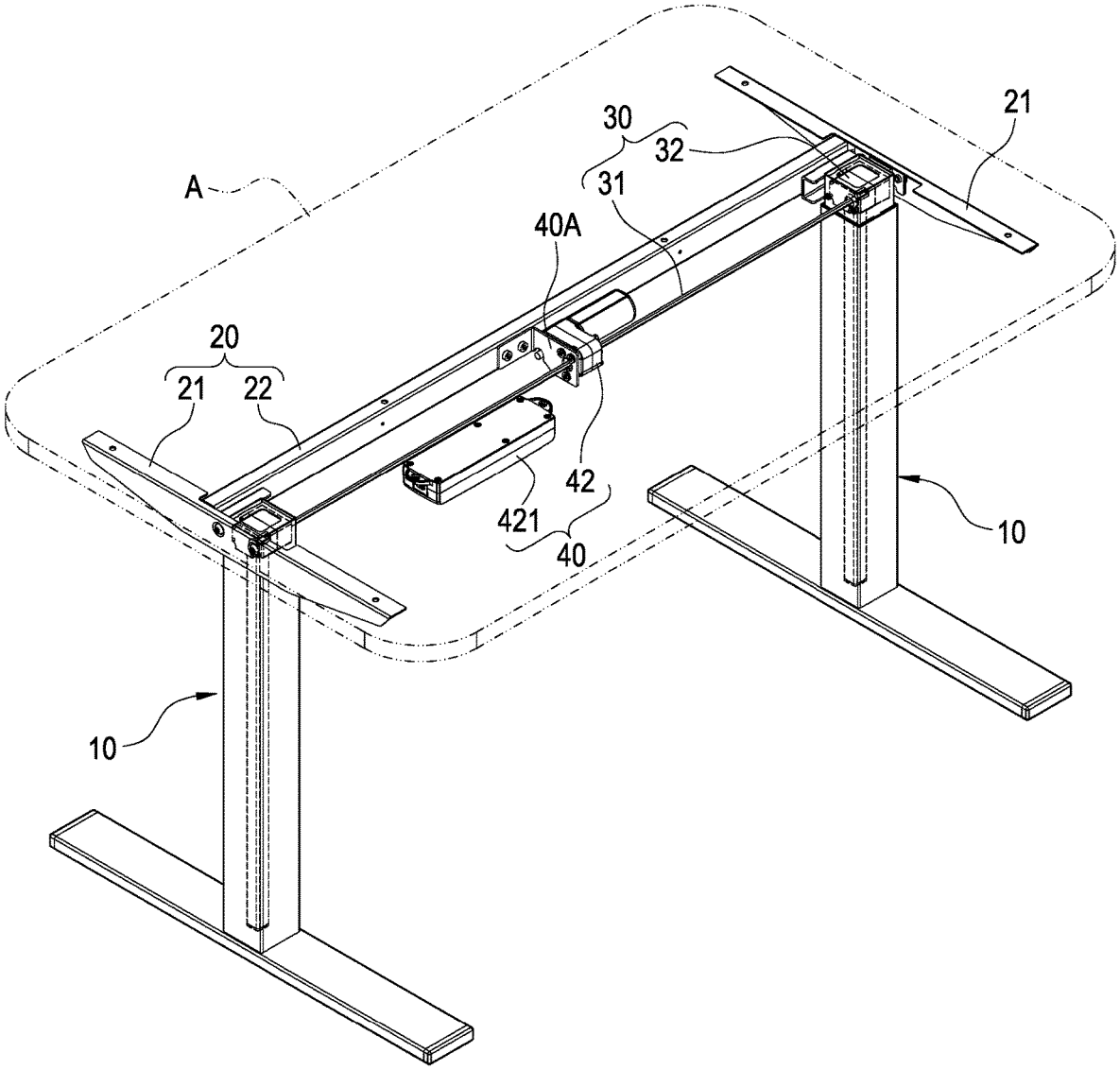
FIG. 6 is a perspective view of a second embodiment of this disclosure.
Figure 7:
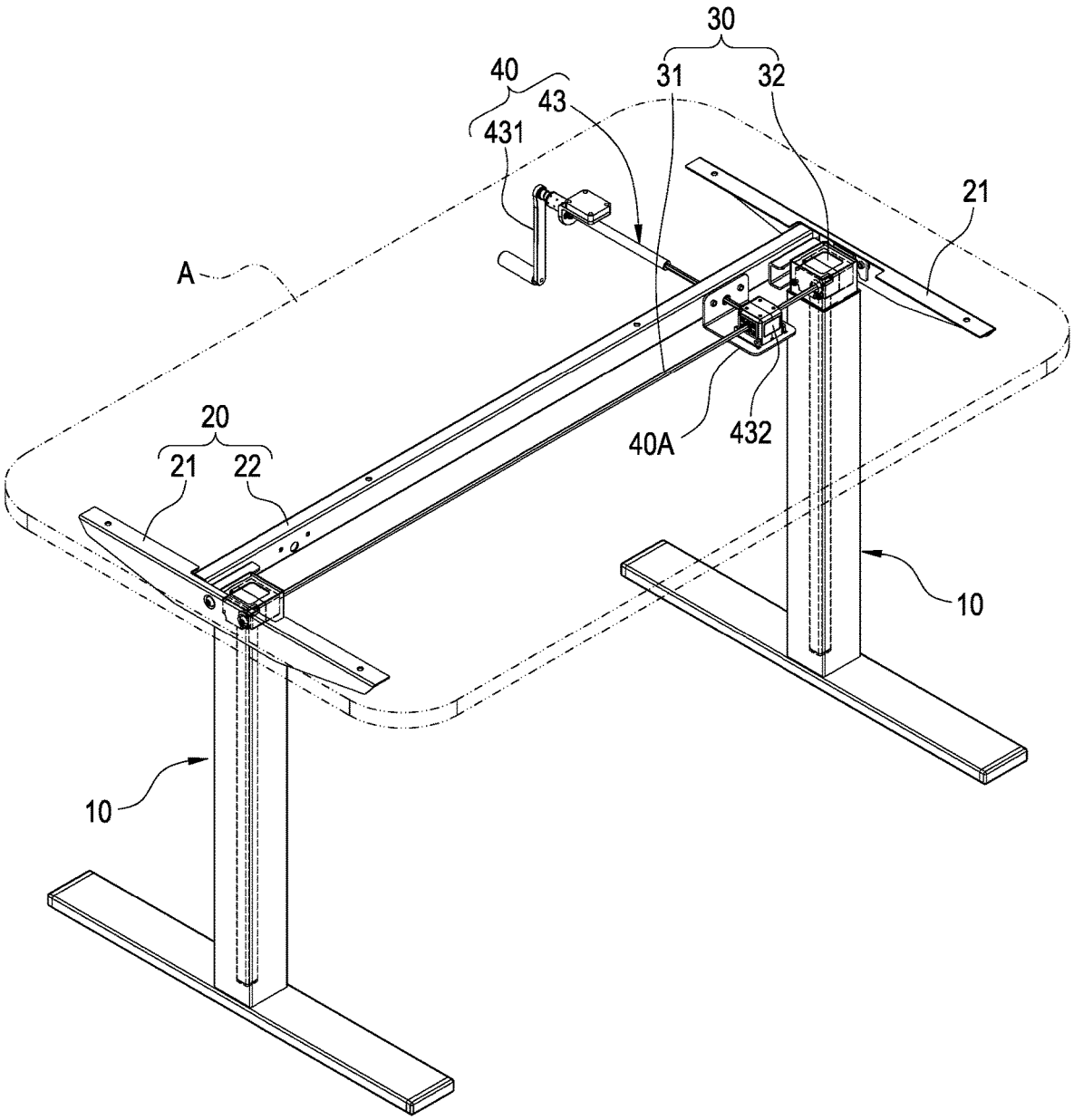
FIG. 7 is a perspective view of a third embodiment of this disclosure.

With reference to FIG. 6 for the second embodiment of this disclosure, the main difference between the second embodiment and the first embodiment resides on that the driver of the actuation module 40 of the second embodiment is an electrical control motor 42 and the actuation module 40 further includes a control box 421 for controlling the electrical control motor 42. The control box 421 may directly control the number of rotations of the electrical control motor 42 to flexibly adjust the height of the table according to different requirements. With reference to FIG. 7 for the third embodiment of this disclosure, the main difference between the third embodiment and the previous embodiments resides on that the driver of the actuation module 40 of the third embodiment is a hand rotating mechanism 43, and the hand rotating mechanism 43 includes a rotating handle 431 and an adapter 432. The adapter 432 is installed on the receiving member 40A, and the rotating handle 431 is connected to the adapter 432 through another transmission shaft. The adapter 432 may transmit the power generated by the rotation of the rotating handle 431 to the transmission shaft 31, and then the transmission shaft 31 drives each gear set 33 to lift the telescopic column 10. Therefore, the lifting table stand may be used in a place where there is no electricity, and the height of the lifting table stand may be adjusted manually according to different requirements.

It is noteworthy that the actuation module 40 of the first embodiment of this disclosure is installed according to the following method. The current cutoff motor 41 is mounted onto the receiving member 40A first, and then the transmission shaft 31 is made to pass and be connected to the current cutoff motor 41, and finally the receiving member 40A is screwed onto the beam 22 to complete the installation of the actuation module 40.

The actuation module 40 of the second embodiment of this disclosure is installed according to the following method. The electrical control motor 42 is mounted onto the receiving member 40A, and then the transmission shaft 31 is made to pass and be connected to the electrical control motor 42 and the receiving member 40A is screwed onto the beam 22, and finally the control box 421 is mounted onto the tabletop A to complete the installation of the actuation module 40.

The actuation module 40 of the third embodiment of this disclosure is installed according to the following method. The adapter 432 is screwed onto the receiving member 40A, and then the transmission shaft 31 is made to pass and be connected to the adapter 432 and the receiving member 40A is screwed onto the beam 22, and finally the rotating handle 431 is connected to the adapter 432 to complete the installation of the actuation module 40.

In the aforementioned three embodiments of this disclosure, each actuation module 40 may be used for the control of lifting the lifting table stand. If it is necessary to change the actuation module 40, the users simply need to reverse the installation procedure according to any one of the foregoing three embodiments in order to remove the receiving member 40A together with the driver from the beam 22, and then install a different type of actuation module 40 onto the beam 22 according to the foregoing installation methods. With this, the production line may install different types of actuation modules 40 on the receiving member 40A according to different shipping requirements, thereby reducing the amount of stocking in the warehouse and effectively controlling the production cost. On the other hand, the users may replace the actuation module 40 quickly and easily by themselves according to their requirements, without requiring an additional expenditure to buy a new lifting table stand with another type of the actuation module 40.

Figure 8:
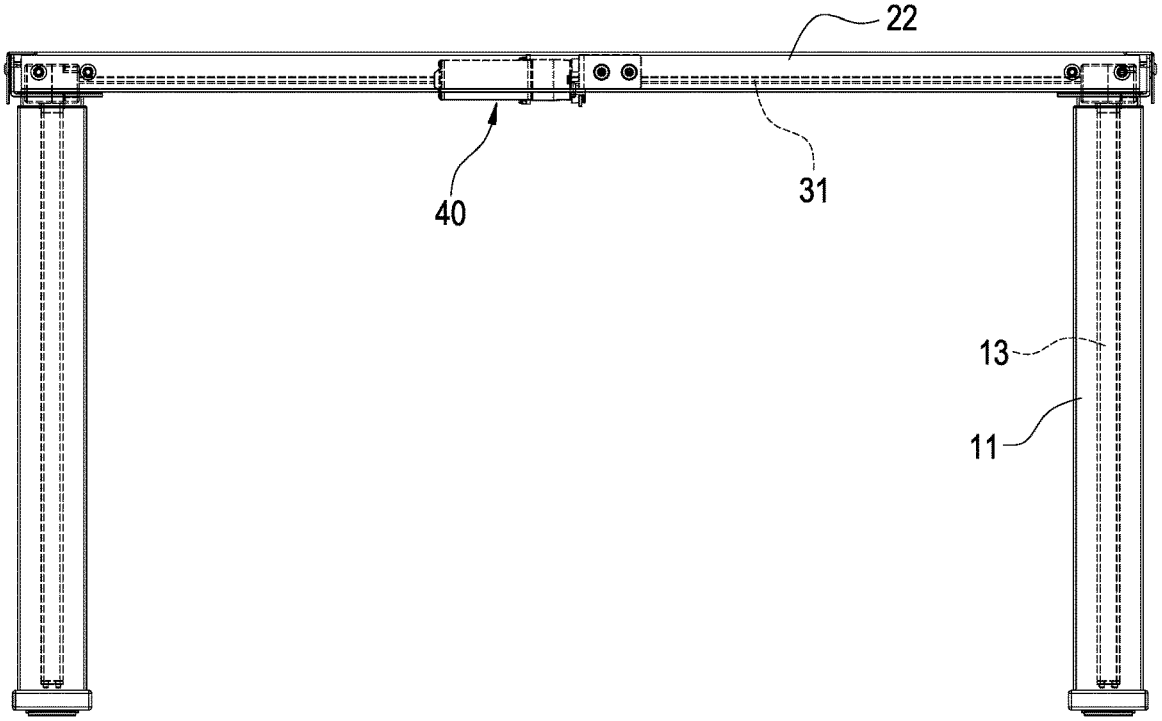
FIGS. 8 and 9 are schematic views showing the first and second using statuses of the first embodiment of this disclosure respectively.
Figure 9:
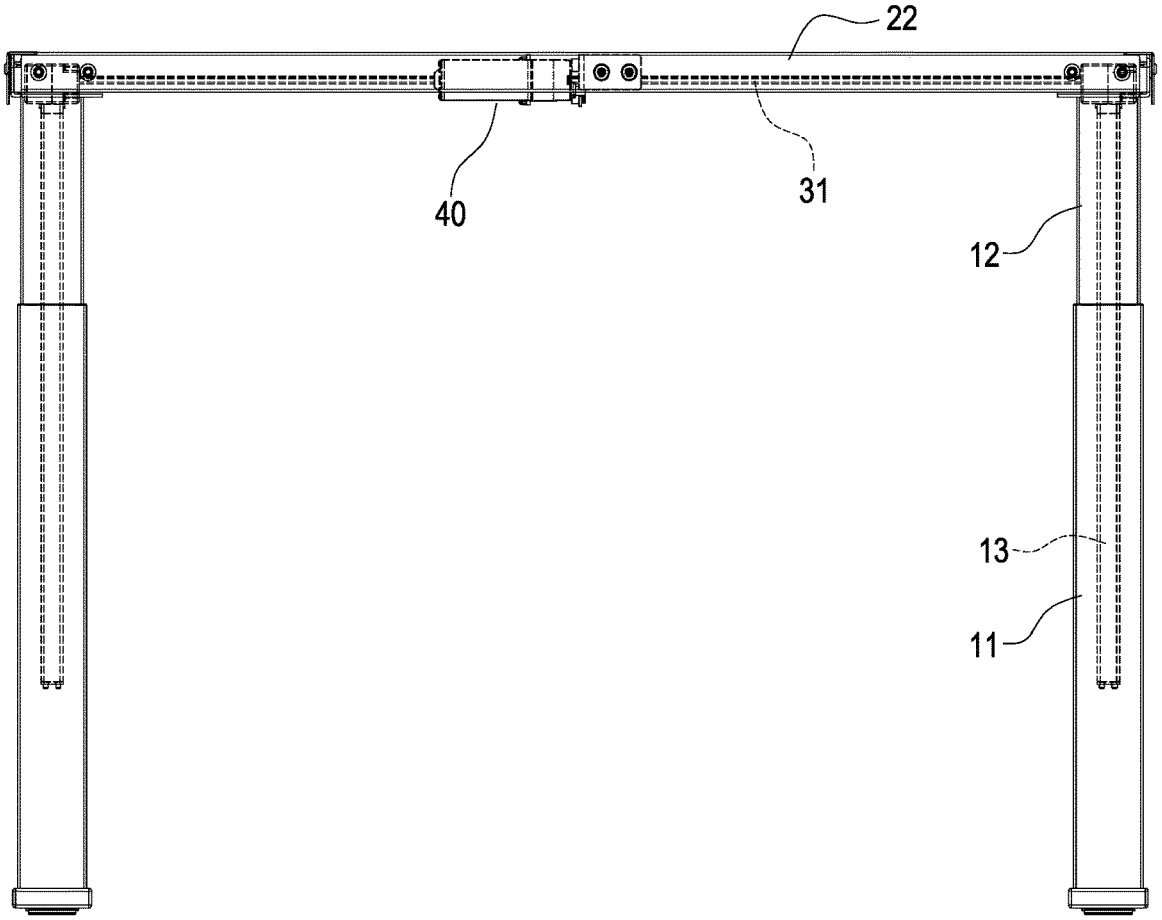

With reference to FIGS. 8 and 9 for the schematic views of the first and second using statuses in accordance with the first embodiment of this disclosure respectively, FIG. 8 is the schematic view showing the lifting table stand at its lowest height, each inner tube 12 is almost completely retracted from each outer tube 11. FIG. 9 is the schematic view showing the lifting table stand at its ascending status, the current cutoff motor 41 keeps rotating to drive the transmission shaft 31 to rotate, and let each gear set 32 connected to the transmission shaft 31 rotate together, so as to drive the corresponding screw rod 13 to rotate and lift each outer tube 11 in each inner tube 12.

In summation of the description above, this disclosure surely achieves the expected objective of use, and overcomes the drawbacks of the related art. While this disclosure has been described by means of specific embodiments, numerous modifications and variations could be made thereto by those skilled in the art without departing from the scope and spirit of this disclosure set forth in the claims.

What is claimed is:

1. A lifting table stand, comprising:

a pair of telescopic columns, arranged spacedly from each other, and respectively comprising a plurality of tubes, the tubes adapted to sheathe with each other and move telescopically relative to each other;

a carrier, comprising a beam and a pair of support members, and the beam straddling the pair of telescopic columns, and each of the support members perpendicularly coupled to two ends of the beam, and each of the support members and the beam fixed to each of the tubes;

an actuation module, comprising a receiving member and a driver directly coupled to the receiving member, and the receiving member detachably installed to the beam; and a passive mechanism, comprising a transmission shaft and a pair of gear sets, and each of the gear sets arranged in each of the tubes, and the transmission shaft passing the driver and coupled to each of the gear sets, wherein each of the telescopic columns further comprises a connecting member fixed to one tube, and each of the connecting members comprises a first connecting plate and a second connecting plate perpendicularly coupled to the first connecting plate, so that the carrier is fixed to each of the connecting members.

2. The lifting table stand according to claim 1, wherein the driver comprises a current cutoff motor, an electrical control motor, or a hand rotating mechanism.

3. The lifting table stand according to claim 2, wherein the actuation module further comprises a control box controlling the electrical control motor.

4. The lifting table stand according to claim 2, wherein the hand rotating mechanism comprises a rotating handle and an adapter, and the adapter transmits power generated by a rotation of the rotating handle to the transmission shaft.

5. The lifting table stand according to claim 1, wherein the tubes comprise an outer tube and an inner tube installed in the outer tube, and each of the inner tubes comprises a joint surface and an outer side perpendicular to the joint surface, and the joint surfaces of the telescopic columns are located on a same plane, and each of the first connecting plates is fixed to each joint surface, and each of the second connecting plates is fixed to each outer side.

6. The lifting table stand according to claim 5, wherein the beam is fixed to each of the first connecting plates, and each of the support members is fixed to each of the second connecting plates.

7. The lifting table stand according to claim 6, further comprising a plurality of screws, and the first connecting plate and the second connecting plate comprising a plurality of screw holes separately, and the support member and the beam comprising a plurality of fixing holes separately, and each screw passing through each fixing hole to be screwed with each screw hole.

8. The lifting table stand according to claim 5, wherein each of the connecting members is fixed to each inner tube by welding.

9. The lifting table stand according to claim 1, wherein the first connecting plate and the second connecting plate are formed in one piece form.

* * * * *